US010358849B2

(12) United States Patent
Glover

(10) Patent No.: US 10,358,849 B2
(45) Date of Patent: Jul. 23, 2019

(54) SYSTEM FOR LATCHING AND UNLATCHING A SWING GATE

(71) Applicant: Jerry Dean Glover, La Selva Beach, CA (US)

(72) Inventor: Jerry Dean Glover, La Selva Beach, CA (US)

( * ) Notice: Subject to any disclaimer, the term of this patent is extended or adjusted under 35 U.S.C. 154(b) by 947 days.

(21) Appl. No.: 14/883,046

(22) Filed: Oct. 14, 2015

(65) Prior Publication Data

US 2016/0376820 A1 Dec. 29, 2016

Related U.S. Application Data

(60) Provisional application No. 62/185,483, filed on Jun. 26, 2015.

(51) Int. Cl.

| | |
|---|---|
| ***E05B 15/00*** | (2006.01) |
| ***E05B 53/00*** | (2006.01) |
| ***E05B 65/00*** | (2006.01) |
| ***E05C 3/16*** | (2006.01) |
| ***E05B 17/10*** | (2006.01) |
| *E05B 47/00* | (2006.01) |

(52) U.S. Cl.

CPC ..... *E05C 3/16* (2013.01); *E05B 15/0093* (2013.01); *E05B 17/10* (2013.01); *E05B 53/003* (2013.01); *E05B 65/0007* (2013.01); *E05B 2047/0064* (2013.01)

(58) Field of Classification Search

CPC ..... E05C 3/16; E05B 17/10; E05B 65/0007; E05B 53/003; E05B 15/0093; E05B 2047/0064

See application file for complete search history.

(56) References Cited

U.S. PATENT DOCUMENTS

| | | | | |
|---|---|---|---|---|
| 8,702,364 | B2 * | 4/2014 | Wang | F16B 41/002 411/134 |
| 8,764,076 | B2 * | 7/2014 | Glover | E05C 3/30 292/225 |
| 9,038,313 | B2 * | 5/2015 | Morrone, III | E06B 9/063 49/464 |
| 9,528,306 | B2 * | 12/2016 | Wepf | E05B 17/2038 |
| 2004/0085755 | A1 * | 5/2004 | Dupont | E05B 17/10 362/100 |

* cited by examiner

*Primary Examiner* — Kristina R Fulton
*Assistant Examiner* — Thomas L Neubauer
(74) *Attorney, Agent, or Firm* — Donald R. Boys; Central Coast Patent Agency LLC

(57) ABSTRACT

A gate latch system has a latch line operating sub-assembly, a gravity latch mechanism, and a latch bar. The latch line operating sub-assembly has a tube of a first length having male threading along the entire length, allowing the tube to be trimmed to length for gateposts of different widths. The system comprises lighting elements in handles and knobs to aid a user in operation.

13 Claims, 5 Drawing Sheets

SYSTEM FOR LATCHING AND UNLATCHING A SWING GATE

CROSS-REFERENCE TO RELATED DOCUMENTS

The present application claims priority to Provisional Patent Application 62/185,483 filed on Jun. 26, 2015, and all disclosure of the parent application is incorporated at least by reference.

BACKGROUND OF THE INVENTION

1. Field of the Invention

The present invention is in the field of entrance and egress hardware including gate latches and pertains particularly to a system for latching and unlatching a gate.

2. Discussion of the State of the Art

In the art of construction, particularly of perimeter fencing, gate latches are used to affect latching between a swing gate and a gatepost. The most common latches are vertical latches that, with the aid of gravity and a passive bar-grabbing design function to latch gates to prevent entrance to or egress from a fenced area.

Many vertical latch assemblies include a flat mounting plate and latch housing with a pivotally mounted latching plate disposed within the latch housing. Gravity keeps the latch plate in the closed position. A rounded front face on the latch plate allows a latch bar to be inserted into the latching position of the assembly, such action lifting the latch plate enough to accept the bar. Gravity then urges the latch plate down over the latch bar providing a latched gate. A limitation with current vertical latches is that there are no user-operated components for opening or for closing the latch. A user may swing the gate closed to effect latching but must manually lift the latch to release the gate.

The inventor is aware of a tube assembly that houses a pull line inserted through the tube that may be tied or otherwise connected to a seat on a vertical latch plate of a mounted latch bar assembly and to a handle or knob on the pull end of the gate post. The tube assembly contains a spring installed over and crimped in place on the pull line to provide resistance on pull or lift up of the latch plate and mild back pressure when released or relaxed to provide some force, however slight, to assist the latch plate to stay closed over the latch bar. One limitation of the tube assembly is that there are no user-operable and aesthetic interfaces on the side of the assembly opposite the pull knob.

Therefore, what is clearly needed is a gate latching and unlatching system that addresses the limitations discussed above.

BRIEF SUMMARY OF THE INVENTION

In one embodiment of the present invention a gate latch system is provided, comprising a latch line operating sub-assembly comprising an elongated tube of a first length greater than a thickness of a gatepost and a tube diameter, the elongated tube having external male threads the full first length and extending through a hole with a bore diameter greater than the tube diameter through the gatepost, a first tubular cap element having a cap length with a female thread from a flanged open end, the flange diameter greater than the hole bore diameter, the female thread matching the thread of the elongated tube, and a substantially closed opposite end having a central hole of a diameter to freely accommodate a latch line, the first cap element threaded onto the elongated tube with the flange bearing on a first side of the gatepost, a second tubular cap identical to the first tubular cap element, the second cap element threaded onto the elongated tube with the flange bearing on a second side of the gate post opposite the first side, such that the cap elements securely contain the elongated tube through the gatepost, a latch line having a first end and a second end, passing through the central hole in the first cap element, the elongated tube and the second cap element, a coil spring having a spring length surrounding the latch line within the elongated tube with a first end bearing on the closed end of the first cap element and a second end bearing on a crimp element crimped to the latch line, and a pull knob affixed to the first end of the latch line such that the pull knob bears on the closed end of the first cap element with the coil spring extended. The system in one embodiment has a gravity latch mechanism comprising a body presenting a mounting flange to the second side of the gatepost, the mounting flange having two side-by-side vertically oriented slots allowing the body to be adjustably mounted to the second side of the gatepost at a point on a vertical centerline below the mounting of the latch line operating sub-assembly, and angled entrance for receiving a latch bar, and a slot for restraining a latch plate, a gravity-operated latch plate mounted at a pivot point in the body, with a groove for receiving and latching the latch bar by rotating around the pivot point, the latch plate having an operating arm extending about two inches upward from the pivot point at an outward angle from the gatepost, the operating arm having a planar portion facing the gatepost with a vertically-oriented slot receiving the second end of the latch line, terminated by a crimp element wider than the slot crimped to the second end, and ending in a separate planar portion oriented for a operating the latch plate manually, such that withdrawing the latch line against the coil spring lifts the latch plate. The system further has a latch bar comprising a horizontally-oriented mounting base having side-by-side horizontal slots adjustably mounting the latch bar by screw fasteners to a gate adjacent the gatepost at a height to engage the latch bar with the gravity latch mechanism, a bar extension extending first outward and then parallel to the gate an extent to engage the latch plate in the gravity latch mechanism with the gate in a closed position, and a handle knob joined to the latch bar by one of the fasteners. Pulling on the pull knob at the first end of the latch line on one side of the gate lifts the gravity latch on the other side of the gate, allowing the gate to swing open, and the spring in the latch line sub-assembly extends the latch line when the pull knob is released, allowing the gravity latch mechanism to reposition to latch the latch bar when the gate closes again.

In one embodiment the pull knob comprises a tubular first portion having an externally threaded open first end and a closed second end having a central opening receiving the latch line retained by a crimp element, and an internally threaded cap closure engaging the tubular first portion. Also in one embodiment the pull knob comprises one or more lighting elements illuminating the knob. Also in one embodiment the one or more lighting elements comprise light-emitting diodes and a power supply mechanism. Also in one embodiment the power supply mechanism incorporates a solar panel.

In one embodiment the handle knob joined to the latch bar comprises a tubular first portion having an externally threaded open first end and a closed second end having a central opening receiving one of the screw fasteners, and an internally threaded cap closure engaging the tubular first portion. Also in one embodiment the handle knob comprises one or more lighting elements illuminating the knob. Also in one embodiment the one or more lighting elements comprise light-emitting diodes and a power supply mechanism. Still in one embodiment the power supply mechanism incorporates a solar panel.

In one embodiment the system further comprises lighting elements joined to one or both of the gatepost or the gate. Also in one embodiment the lighting elements are LEDs powered by one or more solar panels. Also in one embodiment the system further comprises lighting elements in one or more parts of the system or on the gatepost or gate, one or more power supplies providing power to the lighting elements, and one or more manual or automatic switching elements for switching power on and off to individual ones of the lighting elements. And in one embodiment the tubular cap elements exhibit longitudinal ridges providing grip enhancement for a user to assemble the tube and caps through a gatepost.

DETAILED DESCRIPTION OF THE INVENTION

In various embodiments described in enabling detail below the inventor provides a unique system for latching and unlatching a swing gate. The present invention is described using the following examples, which may describe more than one relevant embodiment falling within the scope of the invention.

Figure 1:
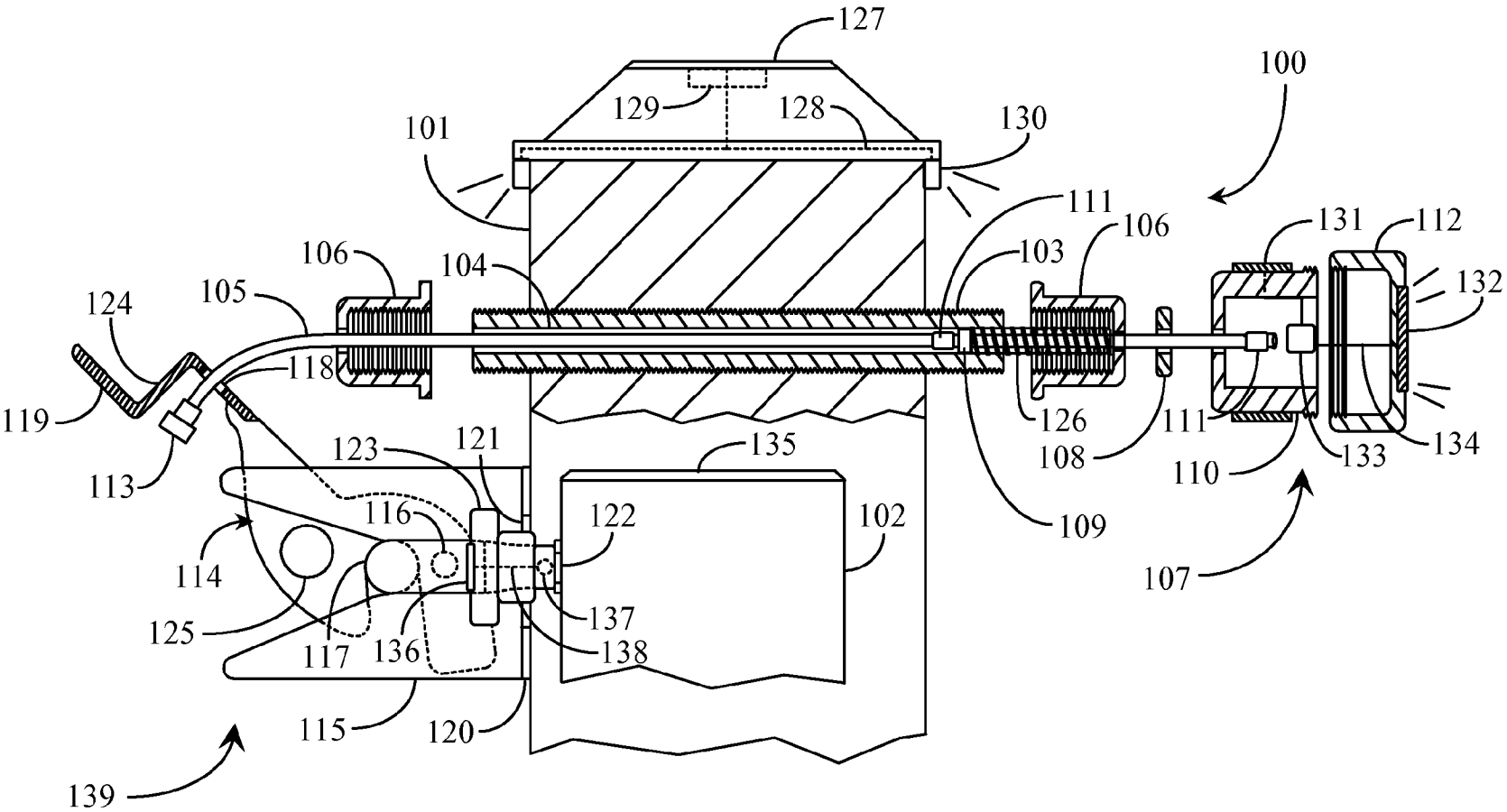
FIG. 1 is a partially sectioned and exploded side elevation view of a gate latching and unlatching system according to an embodiment of the present invention.

FIG. 1 is a partially-sectioned and exploded side-elevation view of a gate latching and unlatching system 100 according to an embodiment of the present invention. System 100 may be installed on and through a gatepost and adjacent vertical gate member such as a gatepost 101 shown partially sectioned, and a vertical gate member illustrated herein as a vertical gate member 102. Gatepost 101 may be made of a variety of materials such as wood, Polyvinyl Chloride (PVC) or some other weather and sun (UV) resistant material, or metal or a combination of materials. Gatepost 101 may be solid such as a solid wooden post or a hollow post without departing from the spirit and scope of the present invention. Vertical gate member 102 may be manufactured of wood, PVC or some other weather and sun (UV) resistant material, metal, or a combination of materials.

System 100 includes an elongate threaded tube 103. Tube 103 may be manufactured of Polyvinyl Chloride (PVC) or some other weather and sun (UV) resistant material or metal without departing from the spirit and scope of the invention. Tube 103 has male threading along the full length thereof in one implementation. Tube 103 is adapted to be inserted through an opening formed through gatepost 101, such as by drilling, and has an outside diameter just smaller than the diameter of the opening formed through gatepost 101. Tube 103 must have a length that is longer than the thickness of gatepost 101 so that it may be secured in position through the post. Tube 103 is therefore preferably provided in a length that would accommodate being cut to length required to facilitate a secure mounting through any host gatepost that is of lesser thickness than the length of tube 103. Tube 103 may therefore be cut to a proper length for gateposts of different thicknesses.

System 100 includes two threaded caps 106 configured to be threaded onto tube 103, one at each end, once tube 103 is cut to proper length and internal elements are assembled. Threaded caps 106 may be molded from PVC or some other weather and sun (UV) resistant material. Caps 106 each comprise a tubular body closed at one end with a central opening through the closed end at proximate center in one implementation. The opening is just large enough to pass a latch line 105. Cap 106 is female threaded on the inside diameter of the body portion at least partly the length of the cap to the closed end. The open end of the cap body includes a flanged rim having an outside diameter larger than the outside diameter of the cap body, and greater in diameter than the diameter of the bore through the gatepost to accommodate tube 103.

Caps 106 thread onto the tube ends with the flanges at the open ends bearing on the gate post, locking the tube into its inserted position through the post. Tube 103 has an inside diameter 104 large enough to accept latch line 105 inserted there through. Latch line 105 may be manufactured of a resilient and flexible material such as PVC or some other weather and sun (UV) resistant material, a coated wire, or a strong fiber line or cord.

Latch line 105 has an outside diameter that is smaller than the inside diameter 104 of tube 103. The inside diameter of tube 103 may be small enough to prevent latch line 105 from doubling or kinking within the tube. In one embodiment a latch spring 126 is assembled over the latch line within tube 103 to provide spring resistance to a pull knob assembly 107, described in detail below, against cap 106 in operation. The inside diameter of latch spring 126 is larger than the outside diameter of latch line 105, and the outside diameter of latch spring 126 is smaller than the inside diameter 104 of tube 103, but larger than the diameter of the central opening through the closed ends of caps 106. One end of spring 126 may therefore bear against the inside of the closed end of cap 106. Latch spring 126 may be a straight spring or a tapered spring without departing from the spirit and scope of the present invention.

Latch line 105 passes through the central openings on the otherwise closed ends of threaded caps 106 at both ends of tube 103 in assembly. Latch spring 126 bears on the inside end of cap 106. At the opposite end of spring 126 a crimp nut 111 is placed over line 105 and crimped closed. In one embodiment a plastic washer 109 resides between crimp nut 111 and the end of spring 126.

Latch line 105 extends further out of threaded cap 106 through an optional rubber or plastic spacer 108 and through the central opening in an otherwise closed end of a pull-handle body 110, which is part of pull knob assembly 107. Pull handle body 110 is closed at one end and open at the opposite end to allow assembly of latch line 105. Handle body 110 may be manufactured of PVC or some other weather (UV) resistant material. A crimp nut 111 is placed on the end of latch line 105 within body 110, and crimped.

In one implementation handle body 110 has male threads on the outside diameter thereof to accept the female threading on a handle cap 112 of pull knob assembly 107. In another implementation handle cap 112 may be snapped onto handle body 110. Handle cap 112 may be connected onto handle body 110 to form a convenient user interface for pulling on latch line 105 against the tension of latch-spring 126.

Cap 112 has a larger outside diameter than handle body 110 which, in turn, has a significantly larger outside diameter than threaded cap 106. Cap 112 provides a highly visible user interface for pulling the latch plate to release the latch bar and swing open the gate. Additionally it serves to hide the connection with latch line 105 within handle body 110.

It will be apparent from FIG. 1, that with tube 103, line 105, spring 126 and pull handle 107 all assembled, handle 107 will bear against cap 106 with some minimum force from spring 126, and a user may pull on pull handle 107 a distance allowed by the length of spring 126, which also will withdraw the opposite end of latch line 105 the same distance, and when the user releases handle 107, the handle will return to cap 106 and the latch line will extend again to it's relaxed position.

An object of the invention is to operate a gravity latch assembly 139 on one side of gatepost 101 by pulling on handle 107 on the other side of the gatepost. Gravity latch assembly 109 comprises a gravity latch housing 115 within which a vertically-oriented gravity-operated latch plate may operate. Similar gravity latches are known in the art, but the gravity latch according to embodiments of the present invention has features previously unknown in the art. Many of the unique features are a part of latch plate 114.

Latch plate 114 may be manufactured of steel or another durable sheet metal suitable for the purpose. Latch plate 114 is generally a flat and relatively thin plate or blade. Latch plate 114 includes a top or neck portion 124 different than known in previous art. One unique feature is that the latch plate has an extended neck portion 124 that extends from assembly 139 at approximately a 45 degree angle from vertical when the gravity latch is closed in latch position. Neck portion 124 is shown partially sectioned in FIG. 1, and may be formed from the same sheet metal as plate 114 by heating and twisting the stock to present orthogonally (flat sides) from the broad flat face of the latch plate. Latch plate 114 may have a uniform thickness.

Neck portion 124 of latch plate 114 hosts a through opening 118 in the form of a slot or round hole. The width of slot 118 is greater than the outside diameter of latch line 105. Latch line 105 is inserted through opening 118 during installation and a crimp nut 111 is crimped onto the end of latch line 105 such that withdrawing line 105 by pulling handle 107 will lift gravity latch plate 114. Crimp nut 111 is not seen in FIG. 1 as it is covered by a plastic cap 113. Extending line 105 again will allow latch plate 114 to return to its rest or latched position. Neck portion 124 has a right-angle bend the ends at "thumb" extension 119. Thumb extension 119 provides a simple user interface point that enables or facilitates lifting of the latch plate 114 from the inside of the gate without pulling on knob 107. Thumb extension 119 may be wider than the rest of neck portion 124. Thumb extension 119 may be annular and the remaining neck portion rectangular in one implementation. Other shapes may also be used such as a rounded square profile.

Latch plate 114 is rotatably pinned within a latch plate housing 115 via a latch pin 116. Latch plate 114 includes a latch bar straight slot having a width just larger than diameter of a latch bar 117, and a depth such that the latch plate may rotate to close over the latch bar in a position relative to pin 116 that pressure on gate 102 will not cause the gravity latch to open. Latch plate 114 includes a through opening 125 which may be used for a pin to lock the latch plate. The latch plate housing may be manufactured of steel or another durable, weather resistant sheet metal. Latch plate housing 115 may be a section of sheet metal bent over on itself with some space between walls to form the housing with a significant portion cut away to provide relief for a latch bar 117 mounted to vertical gate member 102.

The latch plate housing may be formed to provide flat wings 120 to interface with the inside surface of gatepost 101. Each mounting surface of wings 120 includes an elongate opening such as a slot 121, better seen in FIG. 2. Openings 121 enable adjustable mounting of the latch plate housing to the surface of gatepost 101. The length of each slot 121 is sufficiently larger in dimension than the mounting hardware (screws) facilitating manual adjustment up or down, and some angular adjustment of the latch housing for proper fit to accept a gate-mounted latch bar such as latch bar 117. Tube 103 and latch-plate housing 115 are mounted along a common vertical center line, which may or may not be the center line of the gatepost.

Latch bar 117 in one embodiment comprises a shaft portion of a diameter to be captured by the slot of the latch plate, and a rounded end larger in diameter than the shaft. Latch bar 117 may be manufactured of steel or of another durable metal or durable material that may be weather resistant. Latch bar 117 may be manufactured from a steel rod that is machine workable to alter thickness such as for machining the mounting surface and producing the offset bends required to properly mount and extend laterally from the mounted position on vertical gate member 102.

Latch bar 117 is mounted on vertical gate member 102 via a mounting surface (machined flat) on the latch bar on one side. In one implementation a separate mounting plate may be provided to accommodate the mounting of the latch bar on the gate member. Mounting surface 120 of the latch bar includes two slots 122 enabling mounting of the latch bar to the surface of the gate member via screw fasteners. The slots allow for adjustment of the bar in installation to position properly with gravity latch assembly 139.

In one embodiment, a knob-style gate-latch handle 123 is provided to cover the mounting point of the latch bar and provide a user hand interface for opening the gate on the side of the latch plate. To this end the thumb extension provides a convenient user interface for lifting latch plate 114 from that side of the gate.

In operation a user may pull on handle assembly 107 to accomplish upward movement of latch plate 114 against gravity and spring tension to release latch bar 117 allowing the gate to open. The gate may be pushed closed from the other side to recapture latch bar 117 in latch plate 114.

In one implementation system 100 may include battery-powered or solar-powered light emitting diodes (LEDs) integrated with certain components of the system for user convenience. In one variation of this implementation, a solar panel 127 is provided atop gatepost 101. A rechargeable battery 129 may be provided underneath the panel within the gatepost cap. A power line 128 leads to one or more strategically placed LEDs 130. LEDs 130 are distributed about the top of gatepost 101 beneath the post cap. LEDs 130 may be switched on manually (switch not illustrated). In one implementation a timer (not illustrated) may be provided to switch on LEDs 130 when appropriate such as shortly after the sun sets.

In another variation of the lighting implementation, a solar collector ring 131 is provided to fit over pull-handle body 110. A power line 134 connects the collector ring to a rechargeable battery 133 within the hollow space of the handle body. Battery 133 may be mounted or contained in a compartment within the handle body. Power line 134 leads to an LED 132 installed on the user interface surface of handle knob or cap 112. In one implementation both LEDs 130 and 132 are incorporated in combination to provide solar powered lighting for the top down area of the gatepost and for the pull handle cap. The periods of lighting may be controlled by timer.

In still another variation of the lighting implementation, a solar collector 135 is provided atop gate member 102. A power line connects solar collector 135 to a battery 137 contained within latch-gate handle 123. Battery 137 is connected by power line 138 to an LED 136 installed on the interfacing surface of the latch-gate handle. In one implementation lighting is available at the gate handle, under the gatepost cap, and at the latch line pull handle.

In one implementation all of the mentioned lighting positions are integrated via switching elements (not illustrated) where a trigger-event switch such as a switch provided to the latch plate and latch pin assembly may power on the LEDs. In such an implementation, a user may activate powering on of the LEDs by moving the latch plate thus triggering the switch to power on the lights. The lighting may assist the user while navigating through the gate in an otherwise dark or unlighted area. Lighting may also be regulated by a timer as described previously. In one implementation components of system 100 such as handle bodies, caps and knobs may be provided with solar activated coatings or manufactured with glow-in-the-dark materials.

Figure 2:
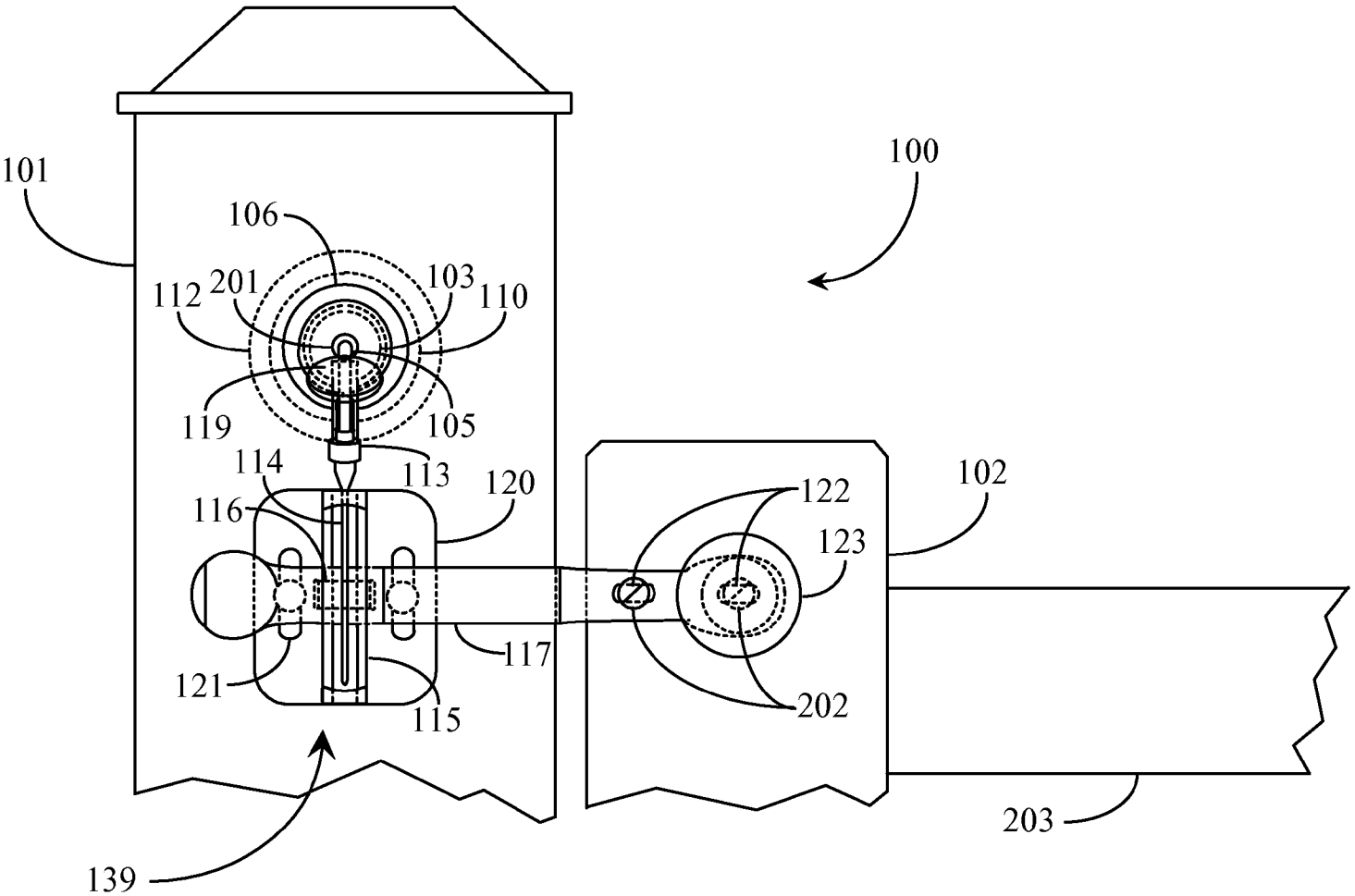
FIG. 2 is a front elevation view of the system of FIG. 1 with the lighting components removed for clarity.

FIG. 2 is a front elevation view of the system of FIG. 1 with the lighting components not shown for clarity. System 100 is rotated in this view to illustrate a front elevation view of gatepost 101 and gate member 102. Latch housing 115 is illustrated joined to gatepost 101. Most of the elements labeled in FIG. 1 are repeated in FIG. 2, to show from a different perspective the association and interactivity of the various elements.

In an implementation using solar powered, AC powered, or battery-powered illumination, light may be provided at the top area of the gatepost extending down to the latch housing and an additional LED on gate handle 123 may illuminate the immediate area about the handle. Latch pin 116 may comprise a small switch activated by movement of the latch plate. The switch may be optical in nature or a physical switch that is activated by contact with a portion of the latch plate.

Figure 3:
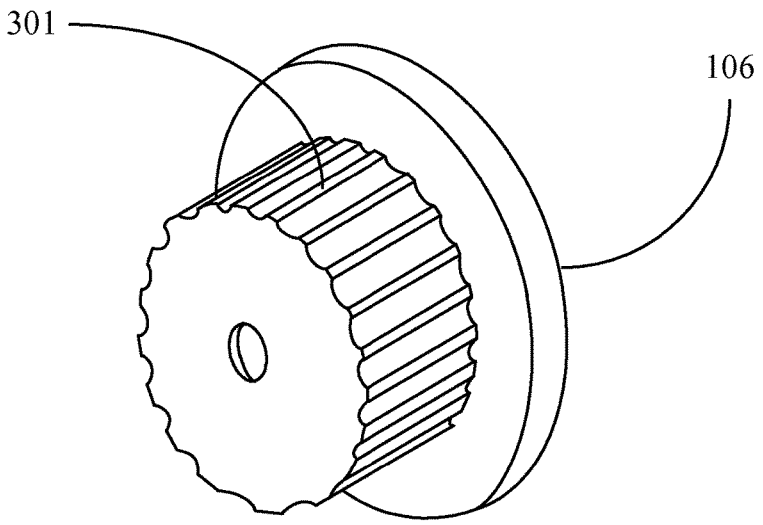
FIG. 3 is a perspective view of the threaded cap of FIG. 1 depicting a ridged outer surface.

FIG. 3 is a perspective view of threaded cap 106 depicting a ridged outer surface. In one implementation, threaded caps 106 have longitudinal ridges 301 molded in the cap body outer surface for the purpose of improving the ability of a user to grasp and turn the caps such as when threading them onto the tube during installation. Cap 106 is shown in FIG. 3 as having a flat end surface, but may be rounded or of other shapes as well.

Figure 4:
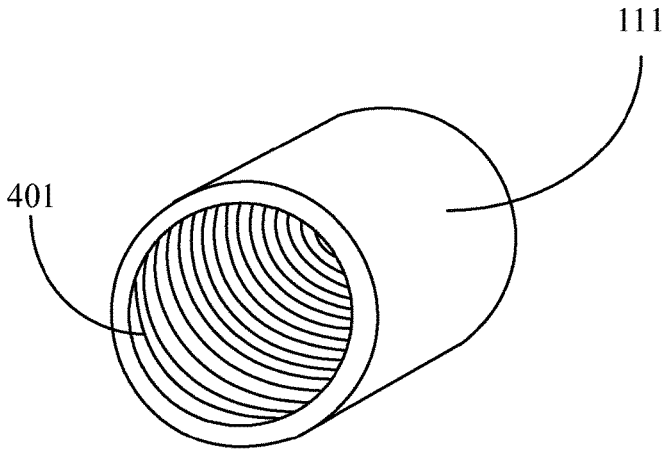
FIG. 4 is a perspective view of a crimp nut of FIG. 1 depicting inside threads for crimping onto the latch line.

FIG. 4 is a perspective view of crimp nut 111 depicting inside threads 401 provided for the purpose of ensuring a secure attachment to latch line 105 when the crimp nut is applied and crimped.

Figure 5:
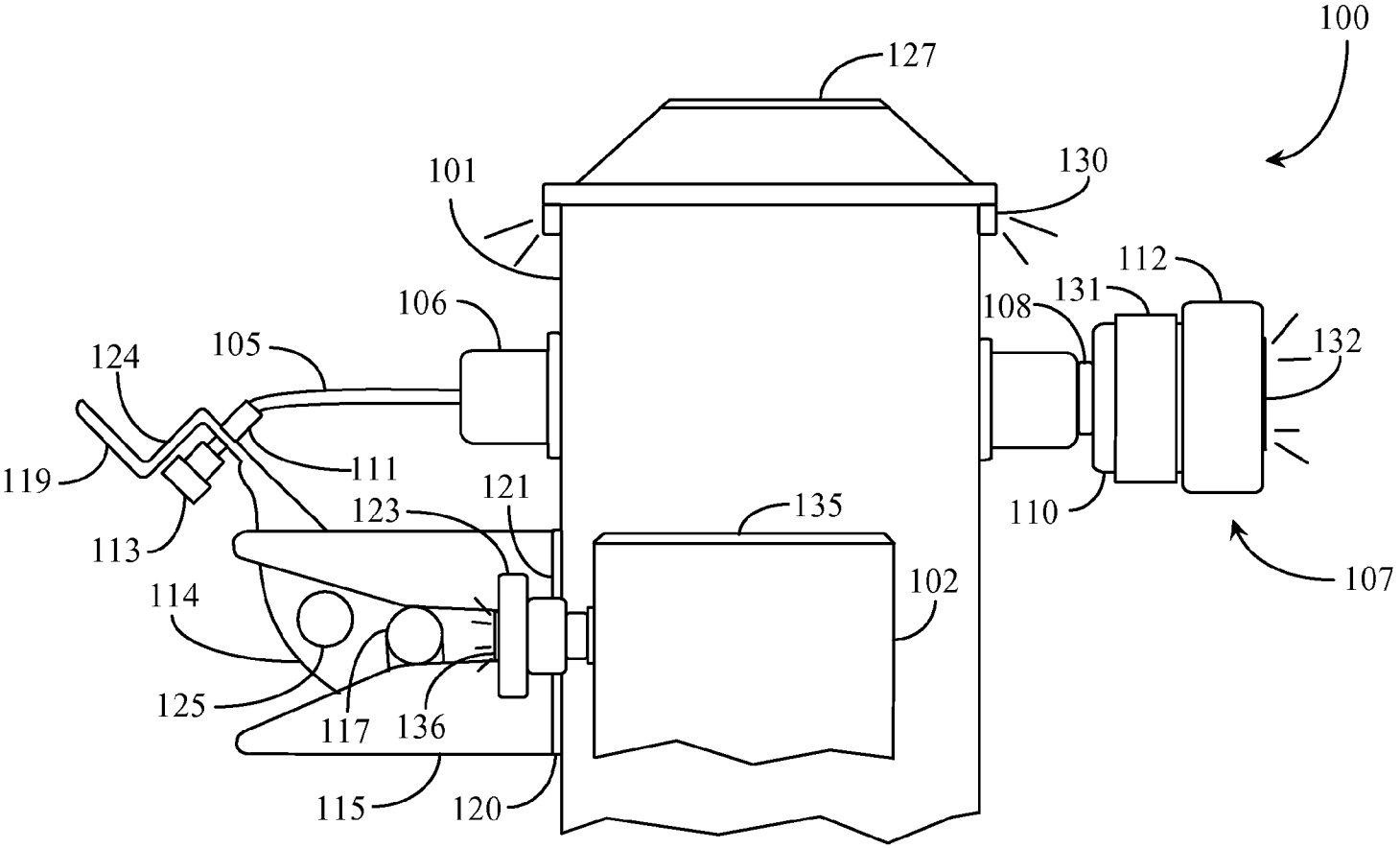
FIG. 5 is a side elevation view of system 100 assembled and latched.

FIG. 5 is a side elevation view of system 100 assembled with the gate closed and latched. Lighting element 130 (LEDs) may light up both sides of the installation. In one implementation light 130 is also provided on the side of the gatepost facing toward the gate. Solar collectors for the LEDs may be provided as described earlier. Again, as with FIG. 2, most of the elements shown in FIG. 1 are again shown to provide a better understanding of placement and interactivity.

In this view an extra crimp nut 111 is provided as a line stop that abuts against the neck portion of latch plate 114 when the latch spring is relaxed. Lighting in the form of LEDs may be provided to pull handle assembly 107 as LED 132 and on gate handle 123 as LED 136. Associated solar collectors may be installed to post and or gate components such as collector 131, collector 135, and collector 127. Batteries may be placed and wired as needed.

FIG. 6 is a side elevation view of gravity latch assembly 139 illustrating an important feature of gravity latch plate 114.

It will be apparent to one with skill in the art that the swing gate latching and unlatching system of the invention may be provided using some or all of the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention.

It will be apparent to the skilled person that the arrangement of elements and functionality for the invention is described in different embodiments in which each is exemplary of an implementation of the invention. These exemplary descriptions do not preclude other implementations and use cases not described in detail. The elements and functions may vary, as there are a variety of ways the hardware may be implemented and in which the software may be provided within the scope of the invention. The invention is limited only by the breadth of the claims below.

The invention claimed is:

1. A gate latch system comprising:

a latch line operating sub-assembly comprising;

an elongated tube of a first length greater than a thickness of a gatepost and a tube diameter, the elongated tube having external male threads the full first length and extending through a hole with a bore diameter greater than the tube diameter through the gatepost;

a first tubular cap element having a cap length with a female thread from a flanged open end, the flange diameter greater than the hole bore diameter, the female thread matching the thread of the elongated tube, and a substantially closed opposite end having a central hole of a first diameter, the first cap element threaded onto the elongated tube with the flange bearing on a first side of the gatepost;

a second tubular cap identical to the first tubular cap element, the second cap element threaded onto the elongated tube with the flange bearing on a second side of the gate post opposite the first side, such that the cap elements securely contain the elongated tube through the gatepost;

a latch line having a first end and a second end and a diameter less than the first diameter of the central hole, passing through the central hole in the first cap element, the elongated tube and the second cap element;

a coil spring having a spring length surrounding the latch line within the elongated tube with a first end bearing on the closed end of the first cap element and a second end bearing on a crimp element crimped to the latch line; and a pull knob affixed to the first end of the latch line such that the pull knob bears on the closed end of the first cap element with the coil spring extended;

a gravity latch mechanism comprising:

a body presenting a mounting flange to the second side of the gatepost, the mounting flange having two side-by-side vertically oriented slots allowing the body to be adjustably mounted to the second side of the gatepost at a point on a vertical centerline below the mounting of the latch line operating sub-assembly, and angled entrance for receiving a latch bar, and a slot for restraining a latch plate;

a gravity-operated latch plate mounted at a pivot point in the body, with a groove for receiving and latching the latch bar by rotating around the pivot point, the latch plate having a first planar portion with the plane oriented vertically, and rotating about the pivot point in a vertical plane, the latch plate having an operating arm in the vertical plane extending about two inches upward from the pivot point at an outward angle from the gatepost, the operating arm having a second planar portion in a plane at a right angle to the first planar portion, the second planar portion having a vertically-oriented slot receiving the second end of the latch line, the second end of the latch line terminated beyond the slot by a crimp element wider than the slot crimped to the second end, and ending in a third planar portion oriented for a operating the latch plate manually, wherein withdrawing the latch line against the coil spring allows the latch line to slide in the slot until the crimped end contacts the second planar portion, engaging and lifting the latch plate; and a latch bar comprising:

a horizontally-oriented mounting base having side-by-side horizontal slots adjustably mounting the latch bar by screw fasteners to a gate adjacent the gatepost at a height to engage the latch bar with the gravity latch mechanism, a bar extension extending first outward and then parallel to the gate an extent to engage the latch plate in the gravity latch mechanism with the gate in a closed position, and a handle knob joined to the latch bar by one of the fasteners;

wherein pulling on the pull knob at the first end of the latch line on one side of the gate lifts the gravity latch on the other side of the gate, allowing the gate to swing open, and the spring in the latch line sub-assembly extends the latch line when the pull knob is released, allowing the gravity latch mechanism to reposition to latch the latch bar when the gate closes again.

2. The gate latch system of claim 1 wherein the pull knob comprises a tubular first portion having an externally threaded open first end and a closed second end having a central opening receiving the latch line retained by a crimp element, and an internally threaded cap closure engaging the tubular first portion.

3. The gate latch system of claim 2 wherein the pull knob comprises one or more lighting elements illuminating the knob.

4. The gate latch mechanism of claim 3 wherein the one or more lighting elements comprise light-emitting diodes and a power supply mechanism.

5. The gate latch mechanism of claim 4 wherein the power supply mechanism incorporates a solar panel.

6. The gate latch mechanism of claim 2 further comprising lighting elements joined to one or both of the gatepost or the gate.

7. The gate latch system of claim 6 wherein the lighting elements are LEDs powered by one or more solar panels.

8. The gate latch system of claim 1 wherein the handle knob joined to the latch bar comprises a tubular first portion having an externally threaded open first end and a closed second end having a central opening receiving one of the screw fasteners, and an internally threaded cap closure engaging the tubular first portion.

9. The gate latch system of claim 8 wherein the handle knob comprises one or more lighting elements illuminating the knob.

10. The gate latch mechanism of claim 9 wherein the one or more lighting elements comprise light-emitting diodes and a power supply mechanism.

11. The gate latch mechanism of claim 10 wherein the power supply mechanism incorporates a solar panel.

12. The gate latch system of claim 1 further comprising lighting elements in one or more parts of the system or on the gatepost or gate, one or more power supplies providing power to the lighting elements, and one or more manual or automatic switching elements for switching power on and off to individual ones of the lighting elements.

13. The gate latch system of claim 1 wherein the tubular cap elements exhibit longitudinal ridges providing grip enhancement for a user to assemble the tube and caps through a gatepost.

* * * * *